US007954344B2

(12) United States Patent
Kim et al.

(10) Patent No.: US 7,954,344 B2
(45) Date of Patent: Jun. 7, 2011

(54) STEAM GENERATOR AND WASHING MACHINE THEREWITH

(75) Inventors: Jae Mun Kim, Jinhao-si (KR); Jong Deuk Bae, Gimhae-si (KR); Heung Gi Kim, Busan (KR); Ki Chul Woo, Seoul (KR); In Geun Ahn, Changwon-si (KR); Kyeong Hwan Kim, Seoul (KR); Kyung Chul Woo, Seoul (KR); Kyu Won Lee, Busan (KR); Young Soo Kim, Changwon-si (KR); Ji Maeng Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 471 days.

(21) Appl. No.: 11/657,726

(22) Filed: Jan. 25, 2007

(65) Prior Publication Data

US 2007/0186591 A1 Aug. 16, 2007

(30) Foreign Application Priority Data

Jan. 26, 2006 (KR) ..... 10-2006-0008545

(51) Int. Cl.
*D06F 39/04* (2006.01)

(52) U.S. Cl. ..... 68/5 C; 68/15; 34/77

(58) Field of Classification Search ..... 68/5 R, 68/5 C, 15; 34/77
See application file for complete search history.

(56) References Cited

U.S. PATENT DOCUMENTS

| | | | | |
|---|---|---|---|---|
| 2,627,015 A | | 1/1953 | Hackman | |
| 3,869,968 A | * | 3/1975 | Ihlenfeld | 99/280 |
| 4,207,683 A | | 6/1980 | Horton | |
| 4,948,947 A | | 8/1990 | Kang | |
| 5,010,925 A | | 4/1991 | Atkinson et al. | |
| 2004/0187527 A1 | * | 9/2004 | Kim et al. | 68/5 C |
| 2004/0187529 A1 | * | 9/2004 | Kim et al. | 68/207 |
| 2005/0034489 A1 | * | 2/2005 | Oh et al. | 68/5 C |
| 2005/0092035 A1 | * | 5/2005 | Shin et al. | 68/275 |
| 2005/0144735 A1 | * | 7/2005 | Yang et al. | 8/149.3 |
| 2006/0010613 A1 | * | 1/2006 | Jeon et al. | 8/158 |

FOREIGN PATENT DOCUMENTS

| | | | |
|---|---|---|---|
| CN | 1580372 A | | 2/2005 |
| DE | 33112 | | 5/1965 |
| DE | 3627988 A1 | * | 4/1987 |
| EP | 0740012 | | 10/1996 |
| EP | 0 877 200 A1 | | 11/1998 |
| EP | 1 507 033 A1 | | 2/2005 |
| EP | 1 616 990 A1 | | 1/2006 |
| EP | 1729065 | | 12/2006 |
| FR | 2778729 | | 11/1999 |
| GB | 702528 | | 1/1954 |
| JP | 2002-106801 | | 4/2002 |
| JP | 2004-24267 | | 1/2004 |
| KR | 20-0128631 | | 12/1998 |
| WO | WO 2005/090866 | | 9/2005 |

OTHER PUBLICATIONS

Electronic translation of DE 3627988, date not applicable.*
European Search Report dated Jun. 28, 2007.

* cited by examiner

*Primary Examiner* — Joseph L Perrin
(74) *Attorney, Agent, or Firm* — McKenna Long & Aldridge LLP

(57) ABSTRACT

A steam generator includes a water chamber for holding water, the water chamber having a heater mounted thereto for heating the water, a steam chamber for holding steam generated as the water is heated, a water supply line for supplying the water to the water chamber, and a steam discharge line for discharging steam from the steam chamber, wherein the water chamber has a vertical direction length relatively greater than a horizontal direction length and the steam chamber has a horizontal direction length relatively greater than the horizontal length of the water chamber. A dryer or washing machine may include the steam generator described herein.

13 Claims, 13 Drawing Sheets

STEAM GENERATOR AND WASHING MACHINE THEREWITH

This application claims the benefit of the Patent Korean Application No. 10-2006-0008545, filed on Jan. 26, 2006, which is hereby incorporated by reference as if fully set forth herein.

BACKGROUND OF THE INVENTION

1. Field of the Invention

The present invention relates to washing machines, and more particularly, to a steam generator for supplying steam to a washing machine, and a washing machine therewith.

2. Discussion of the Related Art

In general, in the washing machines, there are pulsator type washing machines in which washing is made by a water circulation generated by a rotating pulsator, drum type washing machines in which washing is made by head and friction of washing water and laundry formed inside of a drum as the drum laid substantially in a horizontal direction is rotated, and agitator type washing machines in which washing is made by using rotation force of an upright agitator.

In the meantime, recently, a washing machine, particularly, a drum type washing machine is suggested, in which washing and the like are made with steam. If the washing is made with the steam, water and electricity can be saved, the washing performance can be enhanced, and generation of static electricity can be prevented. Moreover, wrinkle and smell can be removed from the laundry.

A related art drum type washing machine with a steam generator will be described, with reference to FIG. 1.

The related art drum type washing machine is provided with a cabinet 10 which forms an exterior of the washing machine, a cylindrical tub 20 supported in a horizontal direction in the cabinet 10 for holding washing water, a drum 30 rotatably mounted in the tub 20, and a driving motor (not shown) for driving the drum 30. The cabinet 10 has a laundry opening 13 in a front in communication with an inside of the drum for introduction/taking out laundry to/from the drum 30, with a door 11 mounted thereon for opening/closing the laundry opening 13. At one side of the drum type washing machine, there is a water supply valve 15 connected to an external water pipe (not shown) for supplying washing water to the tub 20. In general, between a detergent box 27 and the water supply valve 15, there are a hot water pipe 25*a* and a cold water pipe 26 connected thereto.

In the meantime, in the related art drum type washing machine, there is a steam generator 50 for supplying the steam to the inside of the drum 30, with a water supply hose 25 for supplying water and a steam hose 53 for supplying steam to the drum 30 connected thereto. In general, the water supply hose 25 is connected to a hot water side of the water supply valve 15. It is preferable that the steam hose 53 has a nozzle shaped end for smooth spray of the steam into an inside space of the drum 30, preferably with the nozzle shaped end through which the steam is sprayed exposed to the inside of the drum 30.

The steam generator 50 will be described in more detail with reference to FIGS. 2 and 3.

The steam generator 50 is provided with a lower housing 81 which forms an exterior of the steam generator 50 and a space for holding water, an upper housing 82 secured to an upper side of the lower housing 81, and a heater 55 for heating the water in the steam generator 50.

At one side of the upper housing 82, there is a water supply opening 52*b* connected to the water supply hose 25 for supply of the water to an inside of the steam generator 50, and at the other side of the upper housing 82, there is a steam discharge opening 52*a* connected to the steam hose 53 for supplying the steam to the drum 20.

The heater 55, mounted on a bottom of the lower housing 81, is operated in a state fully submerged in the water when the water is introduced into the steam generator 50. For this, mounted to one side of the upper housing 82, there is a water level sensor 60 for sensing a water level of the water held in the steam generator 50. The water level sensor 60 measures the water level inside of the steam generator 50 for always maintaining an appropriate level of the water. That is, if the water level in the steam generator 50 is lower than a reference value (a low water level), the water supply valve 15 is opened, to supply the water, and, if the water level of the inside of the steam generator 50 reaches to a reference value (high water level), the water supply valve 15 is closed, to stop supply of the water, and the heater 55 is put into operation, to generate the steam.

In the meantime, there is a temperature sensor 57 mounted thereto for measuring temperatures of the water heated by the heater 55 and the steam. The temperature sensor 57 is used for turning off power to the heater 55 to prevent the heater 55 from overheating if the temperature of the steam generator 50 measured by the temperature sensor 57 is higher than a reference value.

The water level sensor 60 will be described.

The water level sensor 60 is provided with a receptacle housing 61 which forms an exterior of the water level sensor 60 and provided for securing the water level sensor 60 to the steam generator 50, electrodes 62, 63, and 64 under the receptacle housing 61 for sensing water levels of the steam generator 50. In order to sense water levels of the steam generator 50, the electrodes 62, 63, and 64 are mounted to appropriate heights from the bottom of the lower housing 81. The electrodes are a common electrode 62 which is a reference electrode for sensing a minimum water level, a low water level electrode 63 for sensing a low water level, and a high water level electrode 64 for sensing a high water level. It is preferable that the common electrode 62 has a length at least the same with or longer than the low water level electrode 63.

In the meantime, if the water boils, many bubbles are formed suddenly, which are liable to stick to the electrodes 62, 63, and 64, to cause malfunction of the steam generator 50. Moreover, the water supplied through the water supply opening 122 is liable to splash to the electrodes, to cause malfunction of the steam generator. Moreover, it is difficult to avoid a certain level of vibration during operation of the washing machine, which is liable to cause washing of the water in the stream generator. Therefore, in order to prevent the water level sensor 70 from malfunctioning due to those, the water level sensor 70 is provided with a housing 70. Basically, the housing 70 surrounds the electrodes 62, 63, and 64 and an opened bottom. It is preferable that the housing 70 has an opening 70*s*.

However, the related art steam generator in a washing machine and a washing machine therewith has the following problems.

Referring to FIG. 5, the related art steam generator is rectangular substantially, with a low height L1 and a large width L12. Therefore, it is not easy to mount the steam generator to the washing machine. Because, though the steam generator in general mounted to an upper portion of the washing machine, i.e., between the cabinet and the tub, a space $\tau$ between the tub and the steam generator is not large. Moreover, because valves, hanging springs, and the like are mounted in the space between the cabinet and the tub, there is not so large surplus space. Accordingly, in the related art, mounting of the steam generator is not easy, and the steam generator suffers from damage caused by interference during movement of the washing machine. Moreover, because there is comparatively small gap, the steam generator is liable to collide to suffer from damage due to vibration coming from operation of the washing machine. Moreover, replacement of components is not easy.

On the other hand, it is required to improve performances of the steam generator, such as water consumption, energy efficiency, a steam generating time period, safety, and the like.

SUMMARY OF THE INVENTION

Accordingly, the present invention is directed to a steam generator and a washing machine therewith.

An object of the present invention is to provide a steam generator and a washing machine therewith which enables easy mounting of the steam generator.

Another object of the present invention devised to solve the problem lies on providing a steam generator which can improve performances of a steam generator and a washing machine, and a washing machine therewith.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam generator includes a water chamber for holding water, the water chamber having a heater mounted thereto for heating the water, a steam chamber for holding steam generated as the water is heated, a water supply line for supplying the water to the water chamber, and a steam discharge line for discharging steam from the steam chamber, wherein the water chamber has a vertical direction length (a vertical length) relatively greater than a horizontal direction length (a horizontal length). Preferably, the steam chamber has a horizontal direction length (a horizontal length) relatively greater than the horizontal length of the water chamber. Preferably, the steam generator further includes a reverse flow preventive member provided to at least one of the water supply line and the steam discharge line, for preventing the water and the steam from flowing in a reverse direction. The reverse flow preventive member may be a nozzle shaped flexible member.

In another aspect of the present invention, a steam generator includes a water chamber for holding water, the water chamber having a heater mounted thereto for heating the water, a steam chamber for holding steam generated as the water is heated, a water supply line for supplying the water to the water chamber, and a steam discharge line for discharging steam from the steam chamber, wherein a safety valve is provided to a predetermined position of the steam discharge line for automatic opening in a case a steam pressure is higher than a predetermined value. Preferably, the water chamber has a vertical direction length (a vertical length) relatively greater than a horizontal direction length (a horizontal length). More preferably, the steam chamber has a horizontal direction length (a horizontal length) relatively greater than the horizontal length of the water chamber.

In another aspect of the present invention, a steam generator includes a water chamber for holding water, the water chamber having a heater mounted thereto for heating the water, a steam chamber for holding steam generated as the water is heated, wherein the water chamber has a drain portion, having an opening/closing member provided thereto for automatic opening/closing of the drain portion. Preferably, the water chamber has a vertical direction length (a vertical length) relatively greater than a horizontal direction length (a horizontal length). More preferably, the steam chamber has a horizontal direction length (a horizontal length) relatively greater than the horizontal length of the water chamber. The opening/closing member is a solenoid valve or fabricated by utilizing the siphon principle.

In another aspect of the present invention, a washing machine includes a cabinet which forms an exterior of the washing machine, a tub supported in the cabinet for holding washing water, a drum rotatably mounted in the tub, and a steam generator for supplying steam to the drum. One of the foregoing steam generators is applicable to the washing machine. Preferably, the steam generator is mounted in a space between an upper portion of an inside of the cabinet and an upper portion of an outside of the tub.

Thus, the steam generator of the present invention has the following advantages.

First, the horizontal length of the water chamber shorter than a vertical length thereof permits easy mounting of the steam generator.

Second, performances of the steam generator and the washing machine are enhanced owing to the smaller water consumption and faster generation of steam than the related art steam generator.

Third, a reverse flow of the water and the steam can be prevented, effectively. Safety of the steam generator is improved as the safety valve will be opened in a case the steam generator is over pressurized due to detect at the steam supply line.

Fourth, malfunction of the water level sensor can be prevented, effectively.

Fifth, splashing of the water from the steam generator to the drum can be prevented, permitting to prevent stains from forming on the laundry.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 6:
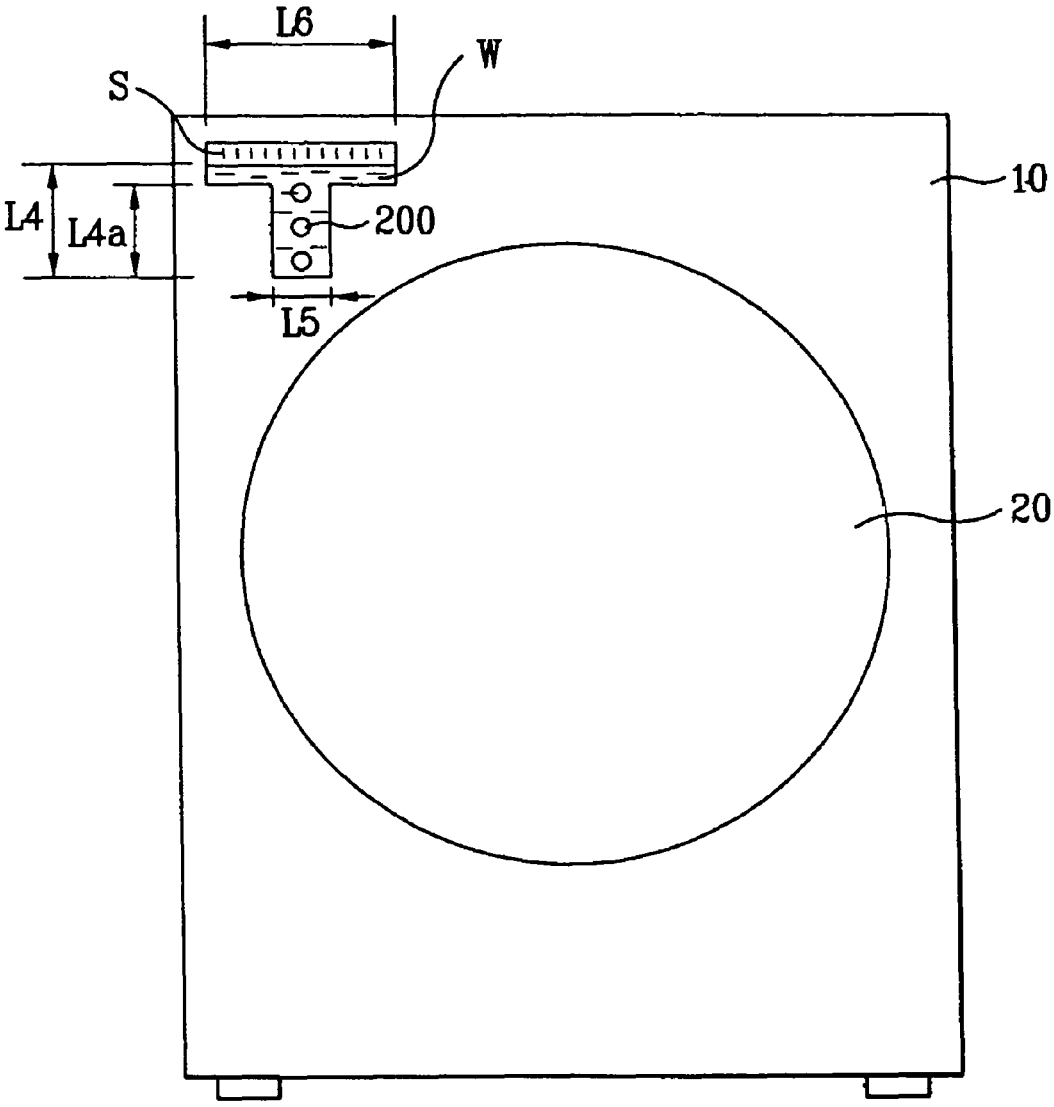
FIGS. 6 to 9 illustrate conceptual drawings each for describing a principle of the steam generator in accordance with a preferred embodiment of the present invention, equivalent to FIG. 5.

A principle of a steam generator in accordance with a preferred embodiment of the present invention will be described with reference to FIG. 6.

Basically, the steam generator 100 includes a water chamber W for holding water, and having a heater 200 mounted therein for heating the water, and a steam chamber S for holding the steam from the water heated by the heater 200. That is, the steam is generated as the water in the water chamber W is heated by the heater 200, and the steam is held in the steam chamber S temporarily, and discharged to an outside of the steam generator through a steam outlet in the steam chamber S.

Figure 1:
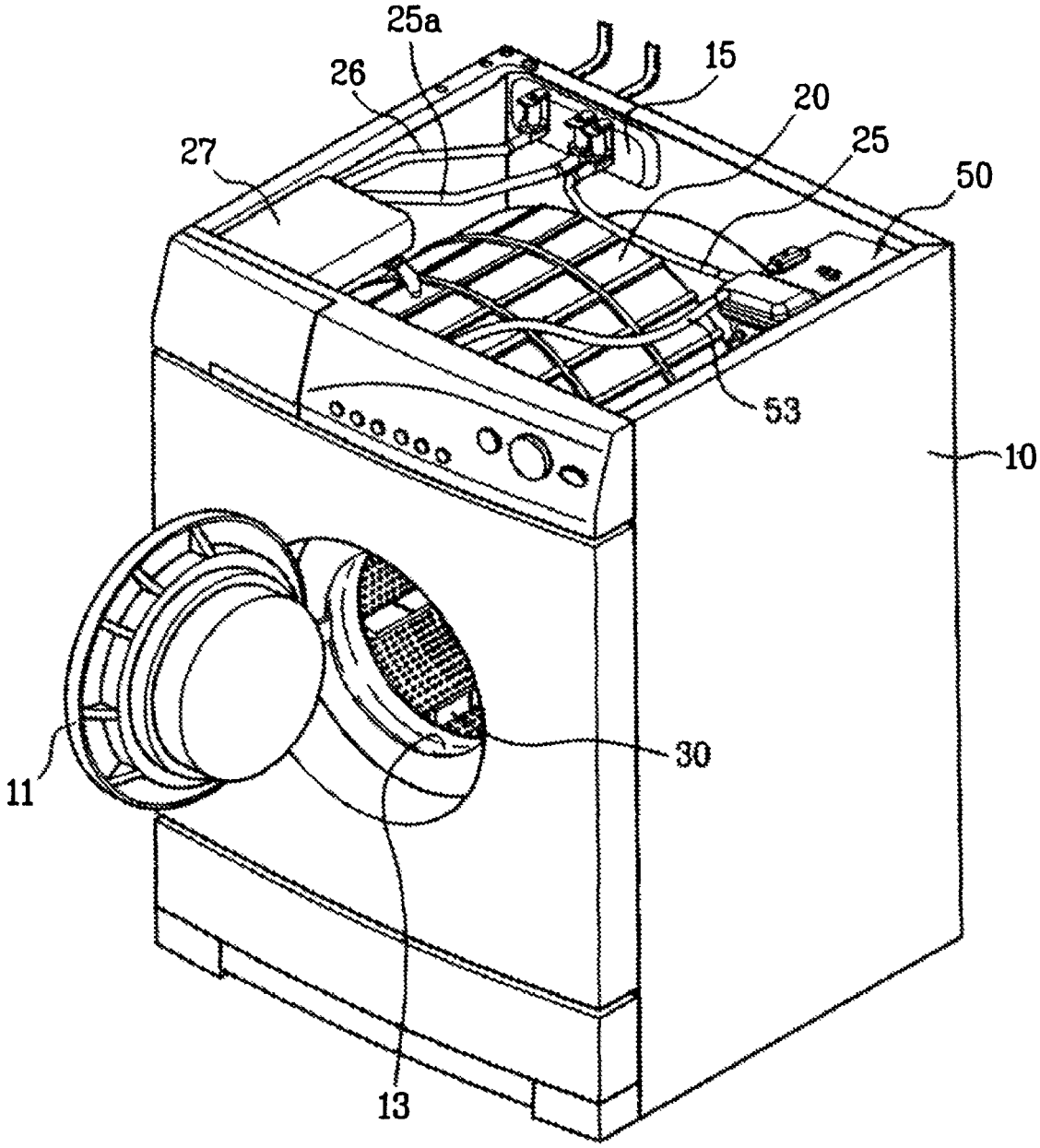
FIG. 1 Prior Art
FIG. 1 illustrates a perspective view of a related art drum type washing machine.
Figure 2:
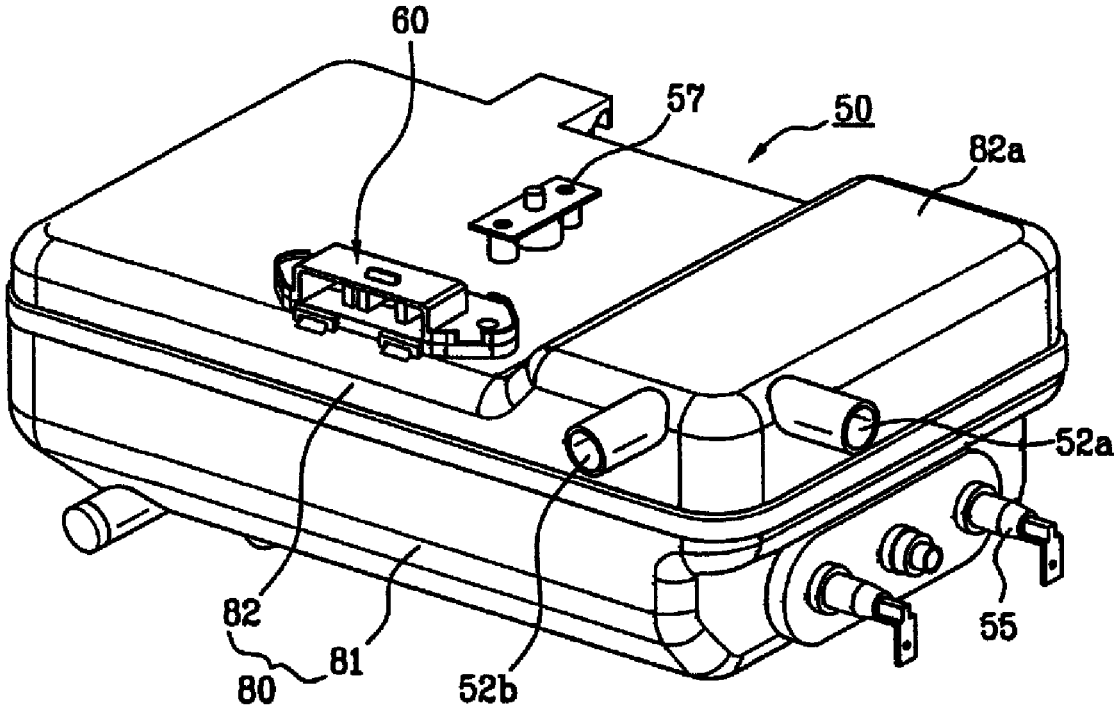
FIG. 2 Prior Art
FIG. 2 illustrates a perspective view of a steam generator in FIG. 1.
Figure 3:
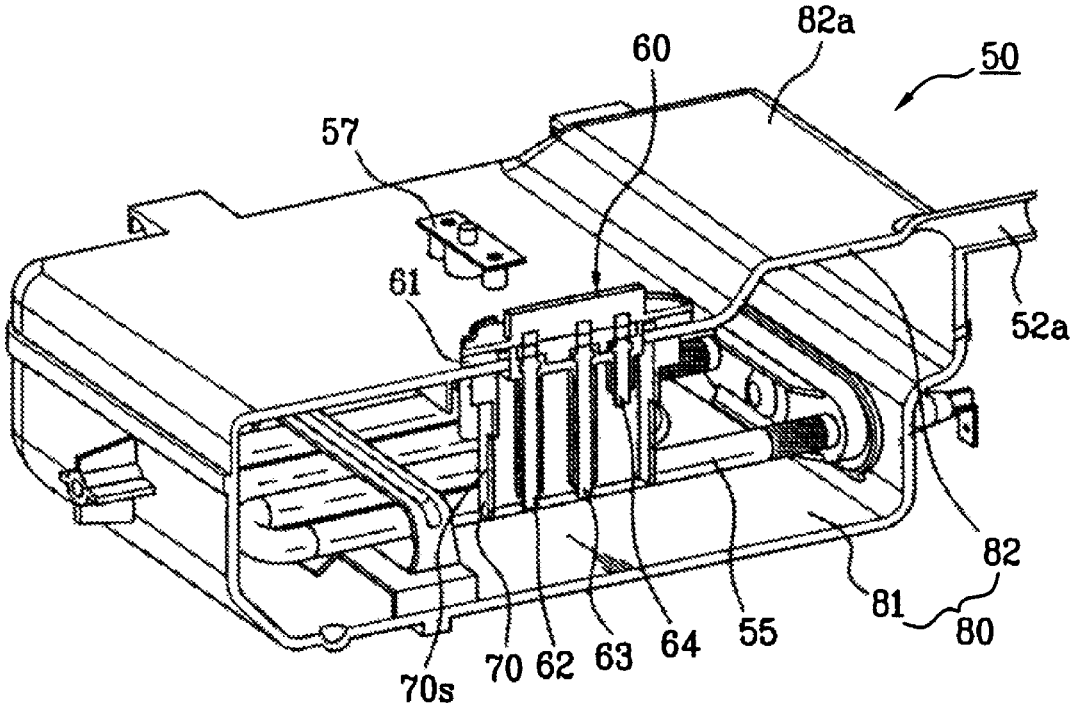
FIG. 3 Prior Art
FIG. 3 illustrates a perspective view of the steam generator in FIG. 2 with a partial cut-away view.
Figure 4:
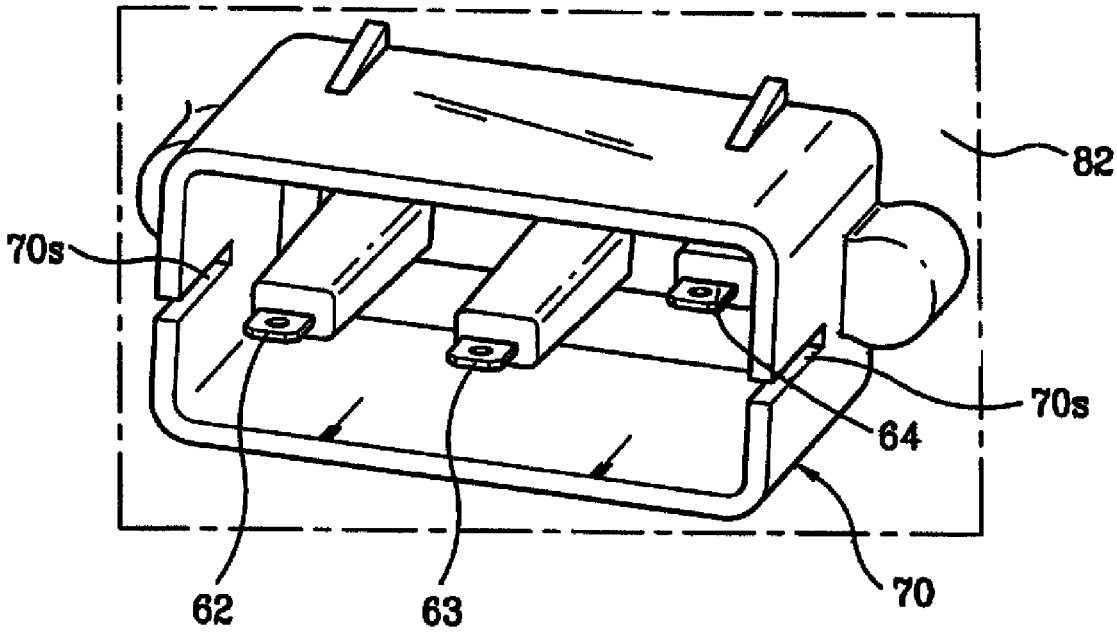
FIG. 4 Prior Art
FIG. 4 illustrates a perspective view of the water level sensor in the steam generator in FIG. 2.
Figure 5:
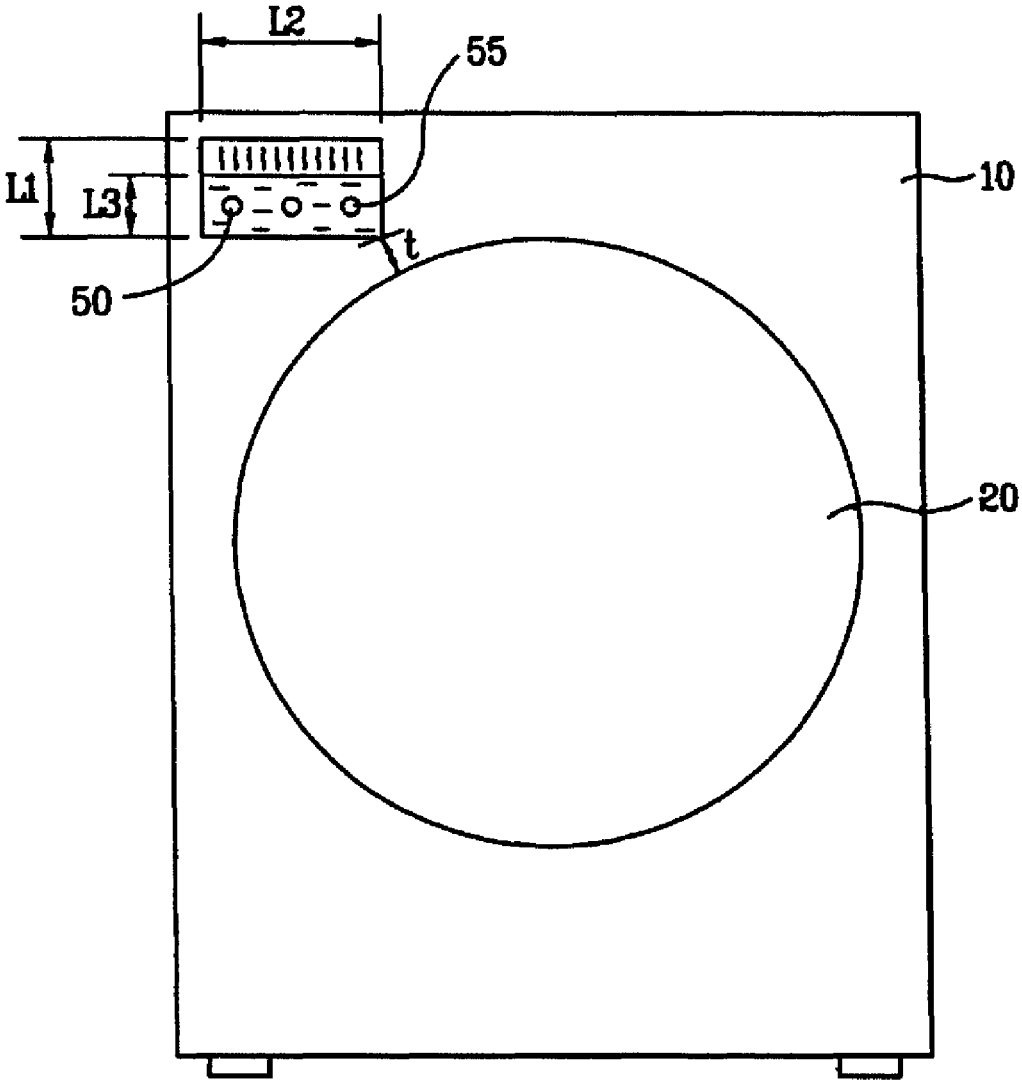
FIG. 5 Prior Art
FIG. 5 illustrates a conceptual drawing showing mounting of the steam generator in FIG. 1.

Referring to FIG. 5, the related art steam generator 50 which is rectangular has a water chamber W with a horizontal length L2 relatively greater than a vertical length L3. That is, the related art steam generator 50 with the heater 55 mounted in horizontally has a vertical length of the water chamber W in a range of a thickness of the heater 55. That is, a horizontal length is made greater, to meet a water capacity requirement. Opposite to this, the steam generator of the present invention has the vertical length L4 of the water chamber W relatively greater than the horizontal length L5 actually. Accordingly, the heater 200 is also mounted in a vertical position actually. As can be known from FIG. 6, even though the vertical length of the water chamber W may be taken as a length L4*a* of a portion the heater 200 is mounted thereto actually, the vertical length of the water chamber W may be taken as a vertical length L4 because it is preferable that the water is filled slightly above the heater 200. Because a difference between L4 and L4*a* is not so much great, most of water in the water chamber W is up to L4*a*. Moreover, under the same reason, a horizontal length of the water chamber W is L5 which is a width of a portion that takes most portion of the water chamber W which holds the water, actually.

The steam generator of the present invention has the following advantages. Since the horizontal length L5 can be reduced compared to the related art steam generator while holding the same amount of water, interference between the tub 20 and the steam generator 100 can be reduced. It is known from the inventor's experiment that the present invention can reduce water consumption and a steam generating period in a case an amount of steam the same with the related art is generated. Accordingly, on the whole, the present invention can reduce a size of the steam generator 100.

In the meantime, it is preferable that the horizontal length L6 of the steam chamber S is relatively greater than the horizontal length of the water chamber W. That is, though the horizontal length L6 of the steam chamber S can also be reduced compared to the related art, it is preferable that the horizontal length L6 of the steam chamber S is the same with or slightly smaller than the related art. Because in general the steam chamber S has a water supply opening and a steam discharging opening, and has the water level sensor and the temperature sensor mounted thereto.

Figure 7:
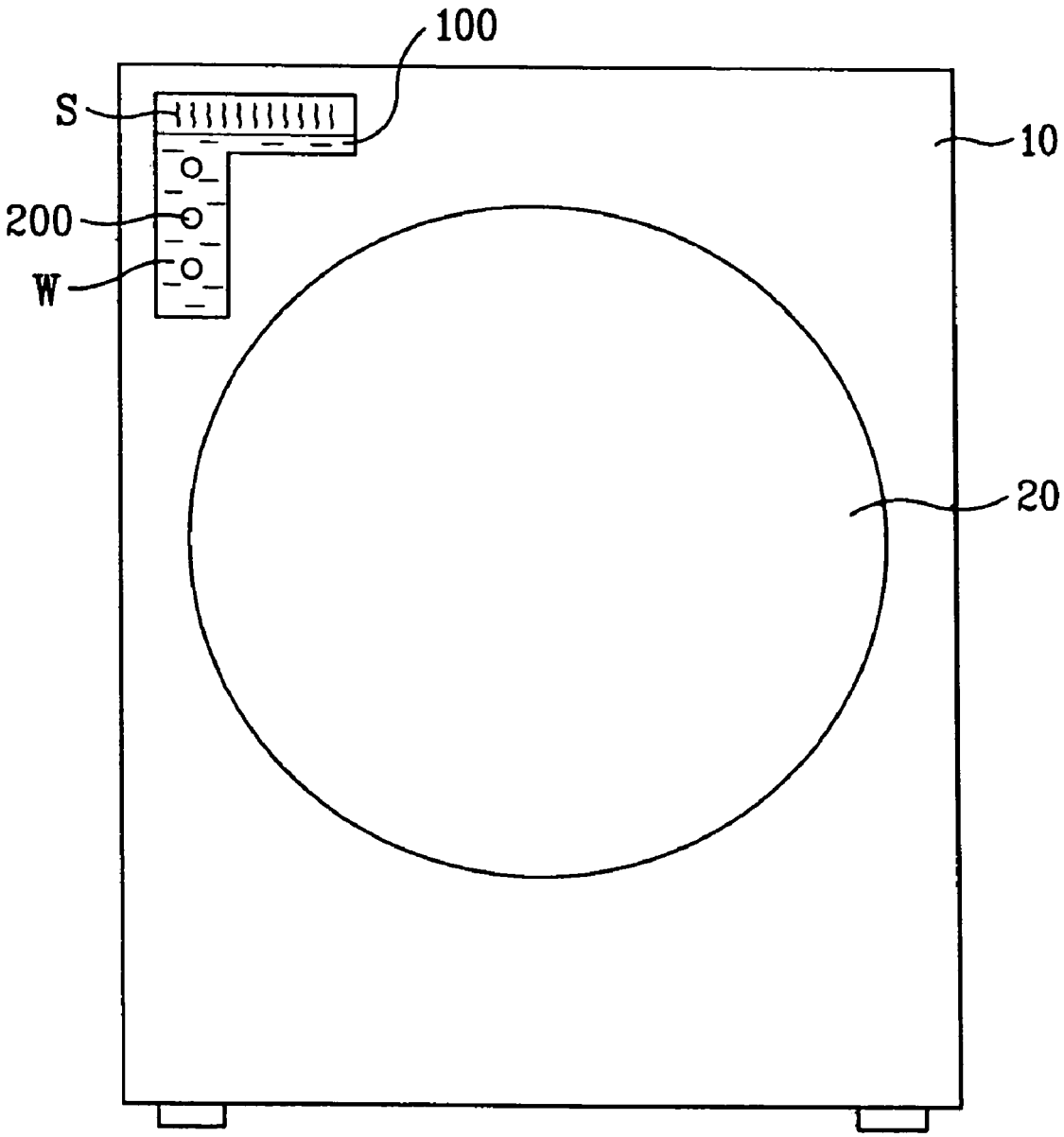
Figure 8:
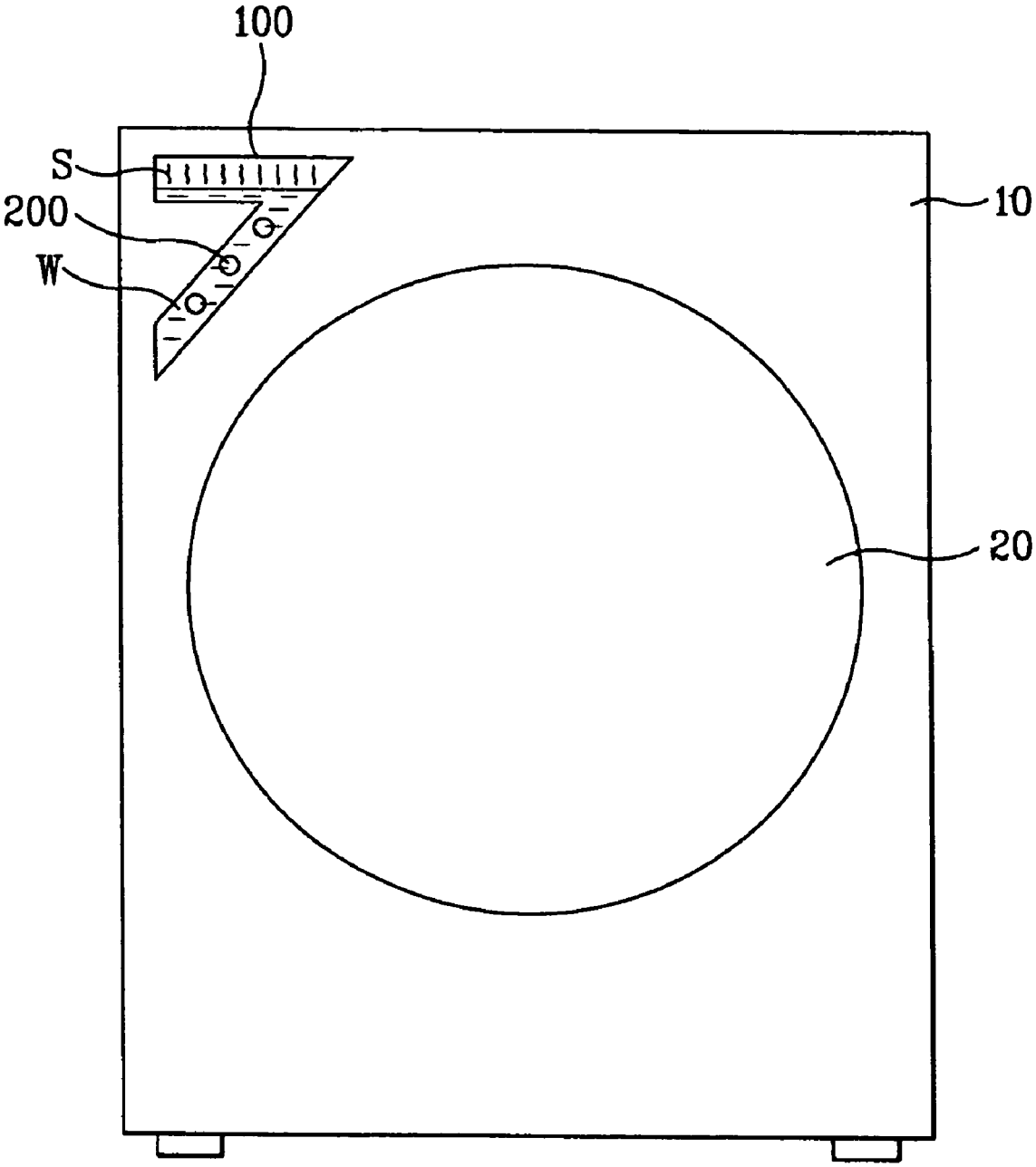

In the meantime, the vertical length L4 of the water chamber W can be made relatively smaller than the horizontal length L5 in a variety of schemes. For an example, as shown in FIGS. 6 to 8, the horizontal length of the water chamber W may be fixed in a vertical direction. In those cases, as shown in FIG. 8, the water chamber W may be sloped with respect to the steam chamber S at a predetermined angle. As shown in FIGS. 6 and 7, in view of fabrication of the steam generator 100, it is preferable that the water chamber W is not sloped with respect to the steam chamber S. In this case, as shown in FIG. 6, it is preferable that the water chamber W is at a center of the steam chamber S, substantially.

Figure 9:
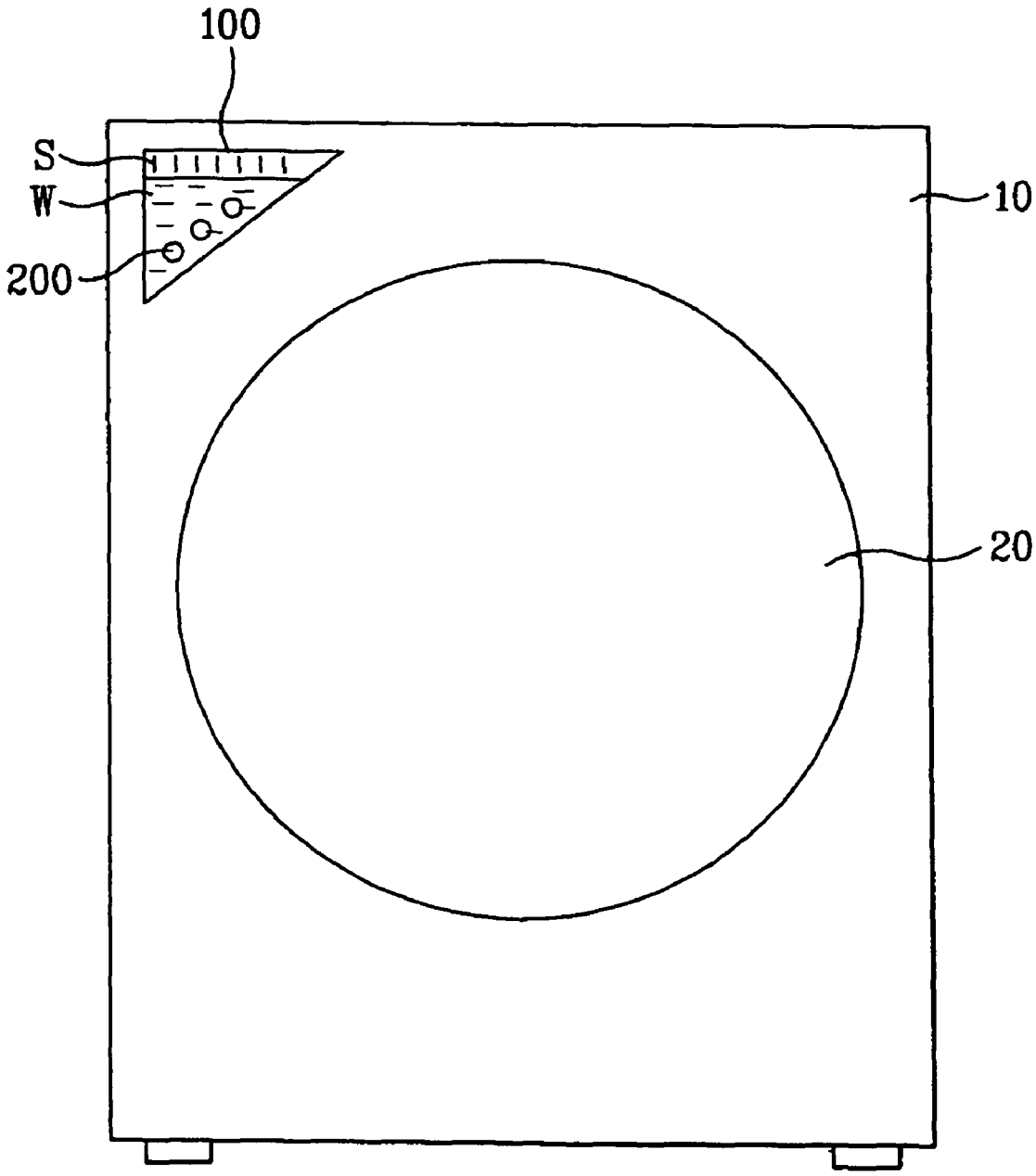

Referring to FIG. 9, the horizontal length of the water chamber W may become the smaller as it goes downward the more. It is known from an inventor's experiment that the steam generator in anyone of FIGS. 6 to 8 has a lower water consumption compared to the steam generator in FIG. 9, and the steam generator in anyone of FIGS. 6 to 8 has a shorter steam generating period than the steam generator in FIG. 9. This is because the steam generator in FIG. 9 holds more water in a case the same size of heaters are used.

In the meantime, it is preferable that the steam generator 100 includes a lower housing which serves as a water chamber W actually, and an upper housing which is secured to a top of the lower housing and serves as a steam chamber S, actually. Of course, depending on a position of fastening of the upper housing to the lower housing, the water chamber W and the steam chamber S may share functions of the water chamber W or the steam chamber S to a certain extent, the lower housing serves as the water chamber W mostly, and the upper housing serves as the steam chamber S mostly.

Figure 10:
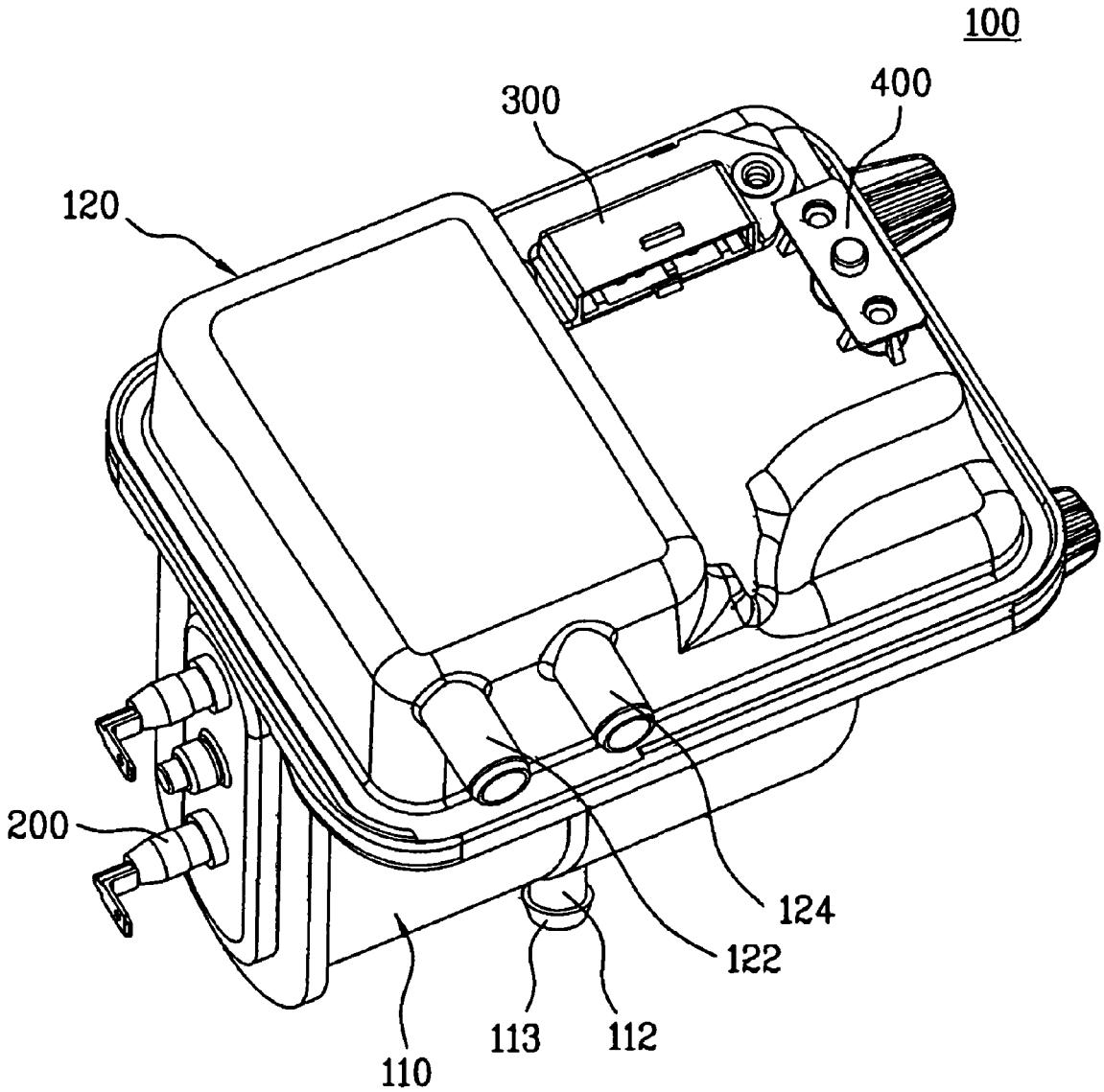
FIG. 10 illustrates a detailed perspective view of the steam generator in FIG. 6.

A steam generator 100 equivalent to one in FIG. 6 will be described with reference to FIG. 10.

The steam generator 100 includes an lower housing 110 and a upper housing 120. The upper housing 120 has a horizontal length greater than a horizontal length of the lower housing. The lower housing 110 has a portion (for convenience sake called as a main portion) 111 having the heater 200 mounted thereto and a vertical length greater than a horizontal length for holding the water mostly, and a portion (for convenience sake called as a connection portion) 112 and 114 extended to opposite directions from the main portion 111 and fastened to the upper housing 120 (see FIG. 12). The water is mostly held in the main portion 111 of the water chamber W, it is preferable that a portion of the water is held in the connection portions 112, and 114, and it is preferable that the connection portions 112 and 114 are sloped toward the main portion 111. By forming thus, deposit of scale on the water level sensor 300 can be prevented.

Since the present invention has relatively higher steam pressure and temperature than the related art, it is preferable that the steam generator is formed of a material which can endure the pressure and temperature. Therefore, it is preferable that the lower housing 110 and the upper housing 120 are fastened together, not by thermal fusion, but by vibratory fusion.

Figure 11:
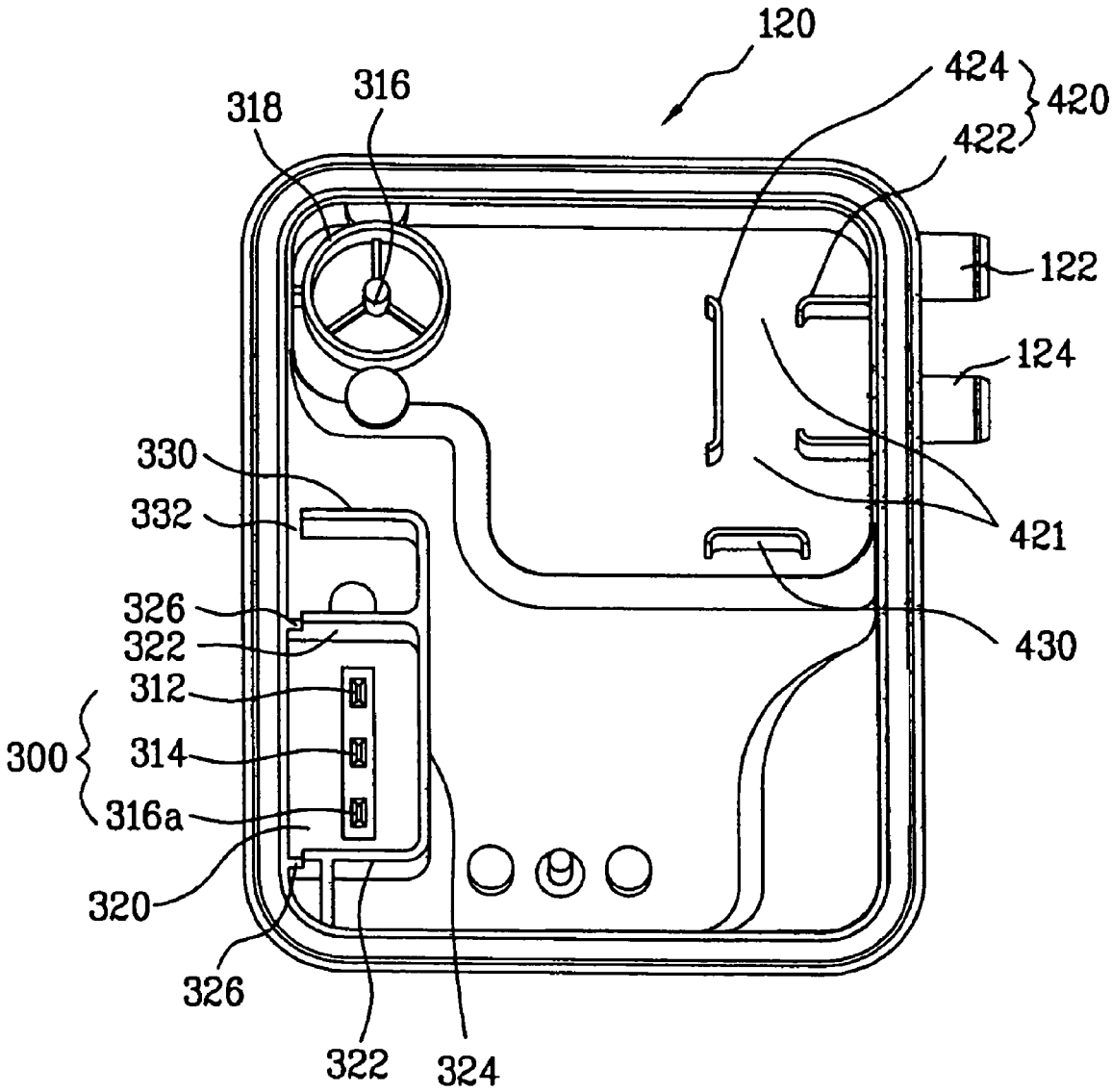
FIG. 11 illustrates an underside view of the upper housing in FIG. 10.

The upper housing 120 which mostly serves as the steam chamber S will be described, with reference to FIGS. 10 and 11.

The upper housing 120 has a water supply opening 122 and a steam discharge opening 124. It is preferable that the upper housing 120 has a portion projected upward, in which the water supply opening 122 and the steam discharge opening 124 are formed therein.

The upper housing 120 has the water level sensor 300 and the temperature sensor 400 mounted thereto. It is preferable that the water level sensor 300 is positioned a predetermined distance away from the water supply opening 122, for an example, away from a water supply direction of the water supply opening 122. By doing thus, malfunction of the water level sensor 300 can be prevented because water splash from the water supply opening 122 to the water level sensor 300 can be prevented. Moreover, it is preferable that the water level sensor 300 is positioned adjacent to an inside wall of the upper housing 120, i.e., over the connection portion 112, or 114, rather than over the main portion 111 of the lower housing 110. In another point of view, it is preferable that the water sensor 300 is spaced a predetermined distance from the main portion 111 of the water chamber W. By doing thus, splash of water and bubbles to the water level sensor 300, which causes malfunction of the water level sensor 300, can be prevented effectively at the time the heater 200 at the main portion 111 of the water chamber W heats, particularly, at the time the heater 200 starts to heat.

In the meantime, there is a housing 320 for housing the water level sensor 300, preferably constructed of a wall. Though the wall may be constructed separately on the whole like the related art, it is preferable that an inside wall of the steam generator 100 serves as a portion of the wall. That is, it is preferable that the wall includes a long wall 324 substantially parallel to the water level sensor 300, and one pair of short walls 322 each having one side connected to the long wall 324, and the other side connected to an inside wall of the upper housing 120. It is preferable that the long wall 324 is positioned over the connection portions 112 and 114 of the lower housing 110, and positioned at a boundary (a position of a wall of the main portion 111 of the lower housing 110 substantially) of the main portion 111 and the connection portion 112 and 114 of the water chamber W.

In the meantime, if the housing 320 has a great height, the housing 320 has an opening 326 for free flow of water from/to the water chamber W. It is preferable that the opening 326 is formed adjacent to the inside wall of the steam generator 100, i.e., at a fore end of the short wall 324.

In the meantime, for effective prevention of water and bubbles from splashing to the water level sensor 300, it is preferable that a supplementary wall 330 is further provided on an outer side of the housing 320. It is preferable that the supplementary wall 330 is arranged to surround a portion of the housing 320, for an example, one of the short walls 322. It is preferable that the supplementary wall also has an opening 332 for free flow of the water from/to the water chamber W, and more preferably adjacent to an inside wall of the steam generator 100. In this instance, it is preferable that the opening 332 is extended to a bottom of the upper housing 120.

In the meantime, the water level sensor 300 includes a common electrode 312, a low water level electrode 314, and a high water level electrode 316, and it is preferable that the high water level electrode 316 is spaced a predetermined distance away from the low water level electrode 314. In such a case, since a standard product having a common electrode, a high water level electrode, and a low water level electrode is in general used as the water level sensor 300, it is preferable that a general water level sensor 300 assembly is used as it is, except that the high water level electrode 316*a* of the water level sensor assembly is not used, but a separate high water level electrode 316 is used. It is preferable that a high water level electrode housing 318, for an example, a cylindrical wall is further provided for housing the high water level electrode 316 positioned away from other electrodes. By doing thus, malfunction of the water level sensor 300 caused by dew between the high water level electrode 314 and the low water level electrode 316 can be prevented.

In the meantime, as described before, the upper housing 120 has a discharge opening 124 for discharging the steam. The discharge opening 124 is provided with a separator 420 for isolating a space the steam is discharged to an outside actually from other space. At the time the water is heated in the water chamber W, particularly at an initial stage of the heating, since the water and bubbles splash heavily, the separator 420 prevents the water from splashing into the drum through the discharge opening 124. If the water splashes onto laundry, stains can appear on the laundry, which can be prevented by the separator 420.

It is required that the separator 420 can be placed in the discharge opening 124, and allows the steam to flow. It is preferable that the separator 420 is walls, preferably with openings 421. Though there is no limitation in shapes of the walls, it is preferable that the openings are form in a vertical direction. It is more preferable that the opening 421 is positioned spaced a predetermined distance away from the steam discharge opening 124.

The walls substantially include a first wall 424 opposite to the steam discharge opening 124, and a second wall 422 extended from the first wall 424 toward the steam discharge opening 124. Though the first wall 424 and the second wall 422 can be formed as one body, it is preferable that the first wall 424 and the second wall 422 may be one pair of walls separated from each other, with the opening 421 formed between the first wall 424 and the second wall 422. It is preferable that the first wall 424 is formed, not over the main portion 111, but over the connection portion 112 or 114 of the water chamber W.

In the meantime, it is preferable that the separator 420 further includes a supplementary separator 430, for an example, a wall, on an outer side. It is preferable that the wall of the supplementary separator 430 is positioned adjacent to the opening 421 of the separator 420. It is preferable that the wall of the supplementary separator 430 is not in contact with the inside wall of the steam generator 100.

Figure 13:
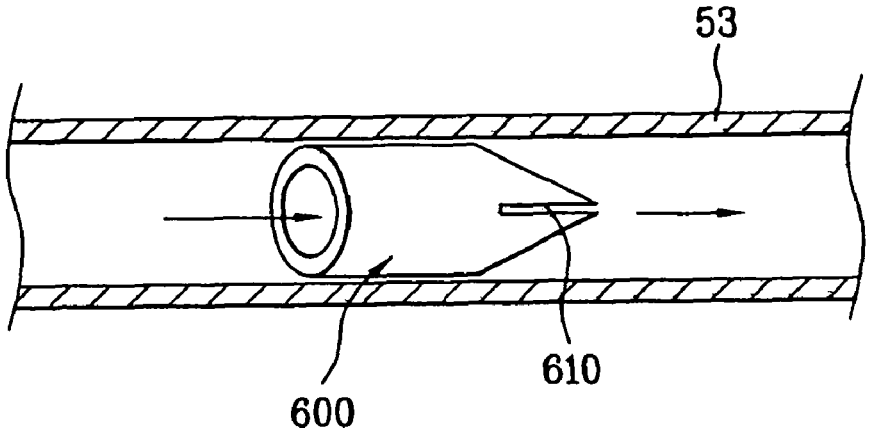
FIG. 13 illustrates a mounted state of a reverse flow preventive member in accordance with a preferred embodiment of the present invention.

In the meantime, as described before, the water is supplied to the water chamber W through a water supply line, such as the water supply hose, the water supply opening 122, and the steam is discharged from the steam chamber S through a steam discharge line, such as the discharge opening 124, and the steam hose. It is preferable that a reverse flow preventive member is provided to at least one of the water supply line and the steam discharge line for preventing the water and the steam from flowing in a reverse direction. The reverse flow preventive member may be anyone that has a reverse flow preventing function, such as an one-way valve. However, because the reverse flow preventive member is mounted on the water supply hose, the water supply opening 122, the discharge opening 124, the steam discharge pipe, all of which have comparatively small diameters, it is preferable that the reverse flow preventive member is a f nozzle shaped flexible member 600 as shown in FIG. 13. It is preferable that the reverse flow preventive member has a cut-opened portion 610 in a nozzle shaped portion.

Figure 14:
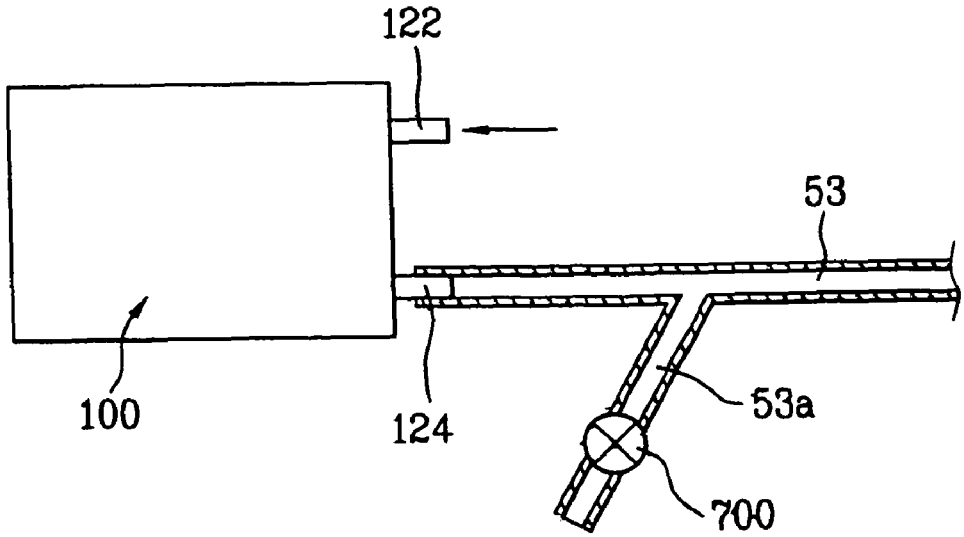
FIG. 14 illustrates a mounted state of a safety valve in accordance with a preferred embodiment of the present invention.

In the meantime, referring to FIG. 14, it is preferable that a safety valve 700 is provided to a predetermined position of the steam discharge line for making automatic opening in a case a steam pressure is higher than a predetermined value. It is preferable that the steam hose 53 is branched to form a branch pipe 53*a*, and the safety valve 700 is mounted to the branch pipe 53*a*. The steam supply line can be over pressurized if the steam is not supplied to the drum due to defect in the steam supply line. In this case, the safety valve 700 is opened automatically, to discharge the steam to an outside of the steam generator.

Figure 12:
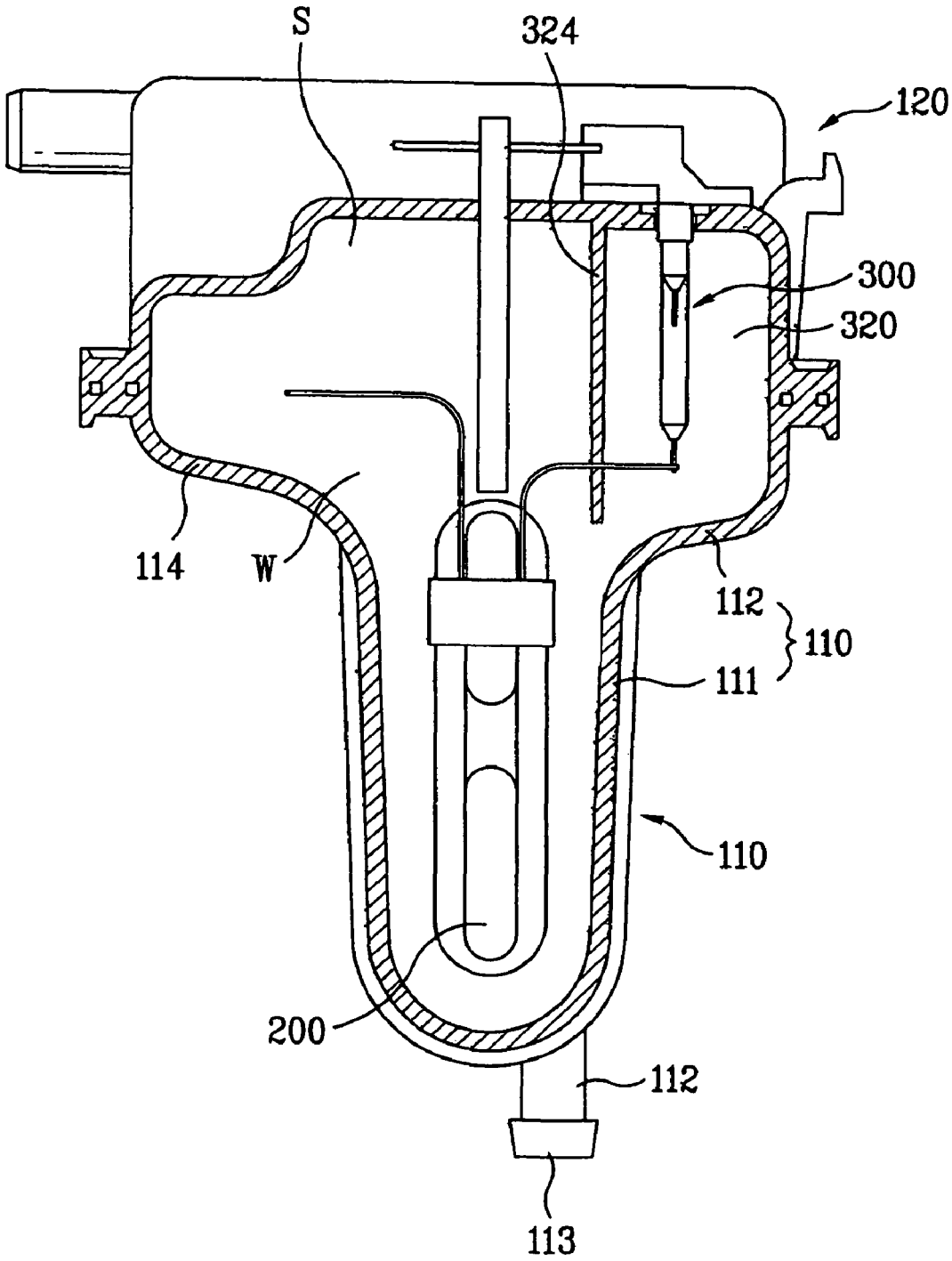
FIG. 12 illustrates a section of FIG. 10.

In the meantime, referring to FIG. 12, the water chamber W has a drain portion 112 for discharging water from the water chamber W to an outside of the steam generator, with an opening/closing member 113 provided thereto for opening/closing the drain portion 112. By opening the opening/closing member 113, the water can be drained from the water chamber W to an outside of the steam generator. In general, if the steam generator 100 is used for a long time, scale deposits on the steam generator 100. However, if the water is drained from the water chamber W to an outside of the steam generator by opening the drain portion 112, the deposition of the scale can be prevented because the water carries away material of the scale.

Though the opening/closing member 113 can be a drain cap which can be opened/closed manually by a user or a service man, an automatic opening/closing member 113 can be used. For an example, the opening/closing member may be a solenoid valve. Moreover, the opening/closing member may be fabricated by using the siphon principle.

In the meantime, it is apparent that inside structures of the steam generator of the present invention described above, such as the wall for the water level sensor, the supplementary wall, the separator, the reverse flow preventive member, the opening/closing member, and the like are applicable to the related art steam generator.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents. For an example, the steam generator of the present invention is also applicable to a dryer which uses steam.

What is claimed is:

1. A dryer or a washing machine comprising:

a cabinet to form an exterior of the dryer or the washing machine;

a drum rotatably provided in the cabinet; and a steam generator provided outside of the drum and at an upper portion of the machine to supply steam to the drum, wherein the steam generator comprises:

a water supply line to receive water;

a steam discharge line to discharge steam;

a heater to heat the water to generate the steam;

a reverse flow preventive member provided to the water supply line, wherein the reverse flow preventive member prevents a reverse flow of steam to the water supply line;

a water chamber to hold the water, the water chamber includes a main portion having a vertical length greater than a horizontal length for mounting the heater thereto and the horizontal length of the main portion is smaller than a horizontal length of any other portion of the water chamber; and a steam chamber to hold the generated steam, wherein the heater is placed in the water chamber, wherein the water chamber has a vertical direction length relatively greater than a horizontal direction length and the steam chamber has a horizontal direction length relatively greater than the horizontal length of the main portion of the water chamber, and wherein the steam chamber is provided above the water chamber to hold steam generated as the water is heated.

2. The dryer or the washing machine of claim 1, wherein the heater is placed in the water.

3. The dryer or the washing machine of claim 1, wherein the reverse flow preventive member is a nozzle shaped flexible member.

4. The dryer or the washing machine of claim 1, further comprising a safety valve at a predetermined position of the steam discharge line for automatic opening if a steam pressure is higher than a predetermined value.

5. The dryer or the washing machine of claim 1, wherein the water chamber includes a drain portion for draining the water to an outside of the water chamber, having an opening/closing member to open/close the drain portion.

6. The dryer or the washing machine of claim 5, wherein the opening/closing member is a solenoid valve for automatic opening/closing of the drain portion.

7. The dryer or the washing machine of claim 5, wherein the opening/closing member utilizes a siphon principle.

8. The dryer or the washing machine of claim 1, further comprising a lower housing and an upper housing secured to a top of the lower housing.

9. The dryer or the washing machine of claim 8, wherein the lower housing includes;

the main portion, and a connection portion extended to opposite sides of the main portion and secured to the upper housing.

10. The dryer or the washing machine of claim 9, wherein the connection portion is sloped at an angle toward the main portion.

11. The dryer or the washing machine of claim 8, wherein the upper housing has a water level sensor for sensing a water level of the water chamber.

12. The dryer or the washing machine of claim 1, wherein the heater is mounted vertically to the water chamber.

13. The dryer or the washing machine of claim 12, wherein the heater is controlled to heat the water at the entirely submerged state in the water chamber.

* * * * *